United States Patent [19]

Keller

[11] Patent Number: 4,583,272

[45] Date of Patent: Apr. 22, 1986

[54] PLATENS FOR PRINTERS

[75] Inventor: Joseph R. Keller, Fairfield, Conn.

[73] Assignee: Alinabal Inc., Milford, Conn.

[21] Appl. No.: 377,704

[22] Filed: May 13, 1982

[51] Int. Cl.[4] ..... B21J 7/00

[52] U.S. Cl. ..... 29/110; 29/110.5; 29/132; 29/148.4 D; 400/659; 400/661.1

[58] Field of Search ..... 29/110, 110.5, 132, 29/148.4 D, 458; 51/103 R, 103 C; 400/659, 661, 661.1, 661.2, 661.4

[56] References Cited

U.S. PATENT DOCUMENTS

| | | | |
|---|---|---|---|
| 1,334,219 | 3/1920 | Bosworth | 400/661.3 |
| 1,728,168 | 9/1929 | Pratt | 29/458 |
| 1,814,365 | 7/1931 | Booth | 51/103 C |
| 3,010,194 | 11/1961 | Fratzke | 29/148.4 D |
| 4,186,162 | 1/1980 | Daley | 400/659 X |
| 4,299,022 | 11/1981 | Kummerl | 29/132 X |

FOREIGN PATENT DOCUMENTS

| | | | |
|---|---|---|---|
| 749541 | 5/1956 | United Kingdom | 29/132 |

OTHER PUBLICATIONS

Duggins et al (Hendren); "Rigid Foam Platen"; IBM Technical Disclosure Bulletin; vol. 17, No. 4, p. 1115, Sep. 1974.

IBM Technical Dislosure Bulletin/J. N. Cassell, Quietized Typewriter Platen, vol. 11, No. 11, Apr. 1969.

*Primary Examiner*—Howard N. Goldberg
*Assistant Examiner*—P. W. Echols
*Attorney, Agent, or Firm*—Pennie & Edmonds

[57] ABSTRACT

A platen for printers is disclosed. The platen has a tubular resilient sleeve with an outer cylindrical circumferential surface. Shaft means is contained within the sleeve. The shaft means has portions exposed at the ends of the sleeve which are concentrically aligned with the sleeve's outer surface. A molded in place core fills the space between the sleeve and shaft means to connect the two together and to prevent their relative rotation. The method of manufacturing the platen includes filling the sleeve with moldable plastic material and subjecting the plastic to a curing operation while holding the shaft portions in concentrically aligned position relative to the outer surface of the sleeve.

5 Claims, 12 Drawing Figures

FIG. 8
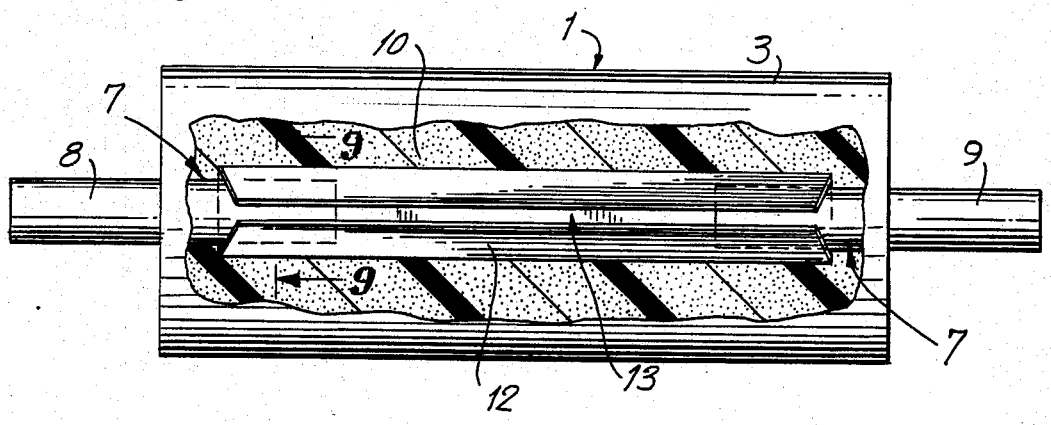
FIG. 9
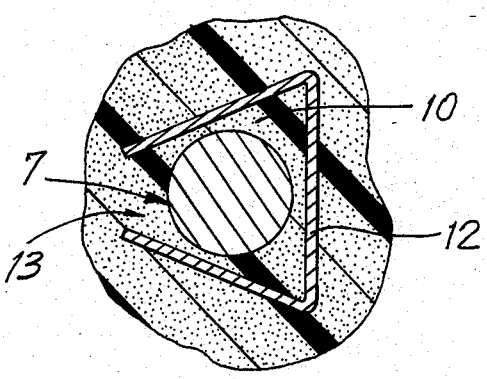
FIG. 10
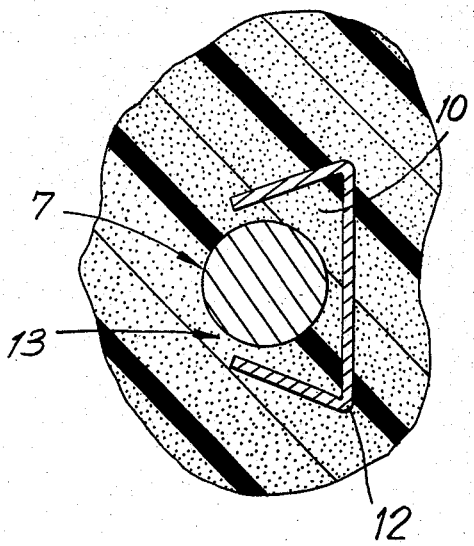
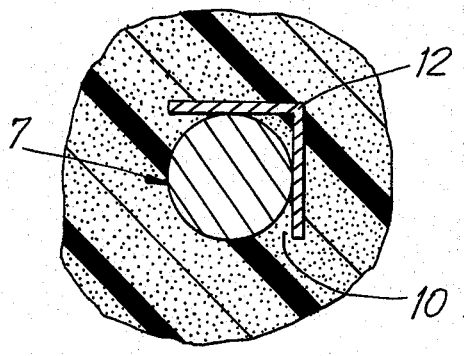
FIG. 11

PLATENS FOR PRINTERS

BACKGROUND OF THE INVENTION

1. Field of the Invention

The following relates to platens commonly used in printers, and especially for high speed printers such as those used in the data processing industry.

2. Description of the Prior Art

Platens are used in high speed printers to position printing paper within the printer so that it may be marked by print elements. The platen, which receives impacts from the print elements as they strike the paper, must have sufficient rigidity to resist excessive deflectional movement. The platen should further be able to dampen vibrations caused by impact of the print elements. Control of platen deflection and vibration is of great importance in high speed printers. It is also important that a high speed printer platen have very precise concentric alignment between the outer circumferential surface of the platen and the mounting journals on which it rotates to prevent eccentric rotation and vibration.

In the past, platen stiffness and damping has been achieved by encapsulating or otherwise sleeving a rigid core with a resilient material such as rubber. Commonly used styles of platens have a cast, wrought or extruded hard plastic or metal sleeve or core. The core is machined to accept journal shafts concentric with the centerline of the core. It is then sleeved with rubber or other resilient material to dampen vibration induced by printer element impact. The final operation in construction of a platen of this type includes a grinding of the outer cylindrical surface of the rubber sleeve. Current practice in fact frequently involves one rough and one finish grinding operation. This is required to create as precise a cylindrical outer surface as possible. With this type of construction, however, core machining errors can lead to initial misalignment of the journal shafts which, in turn, will cause eccentric rotation and vibration of the platen in the printer. Journal misalignment can also cause inaccurate grinding of the outer surface of the sleeve, as the journals are typically used to support the platen during grinding. Metal cores require expensive material and precision machining operations.

In order to reduce costs, platens have also been constructed with parts of the platen structure molded of plastic material. For example, U.S. Pat. No. 3,164,652 shows a method of manufacturing a smooth cylindrically surfaced platen by molding a hollow molten plastic core within a previously formed rubber sleeve. The sleeve is radially constrained in a mold and a mandrel inserted in radially spaced relation within the sleeve. Molten plastic material is then fed into the space between the mandrel and sleeve and allowed to cure. The resulting platen is comprised of an outer sleeve with a molded inner hollow core. No provision, however, is made to provide rigidity to the platen nor does the platen, after the molding operation, have any journals or support shafts. These must be separately manufactured and assembled to the platen core, creating the possibility of misalignment. Thus, if the platen of this connection were to be used in high speed printers, resulting misalignment of the platen in its final assembled position would produce an unsatisfactory condition.

Another type of platen especially designed for business machines, such as typewriters, is disclosed in U.S. Pat. No. 4,186,162. In construction, a metal or plastic tube is used as a core with concentrically aligned journals attached to plugs or collars fitted into the ends of the tube. The tube is filled with a foam plastic mixture for absorbing noise and is finally covered with a resilient sleeve. As for the method of making the platen, a rod is inserted into a first plug and the plug inserted a preselected distance into one end of the tube. A chemical foam mix is fed into the open end of the tube and the other end is then fitted with a second plug, which also retains the rod. The foam mix is cured to form a noise absorbing chamber. The completed tube is then ready for further fabrication, such as covering of the tube with a resilient sleeve. Use of a platen of this type of construction in a high speed printer could clearly present alignment problems because of the manner in which the axle structure is constructed. Furthermore, since the basic structure of the platen, i.e. metal core, outer rubber sleeve, is the same as the previously discussed platens, accurate journals would have to be precisely machined and assembled and the outer sleeve would require final grinding.

A method of roll construction similar to that of U.S. Pat. No. 4,186,162 is disclosed in U.S. Pat. No. 3,662,446. This patent, however, relates to a composite lightweight roll used in corrosive environments. In constructing the roll, a shaft is concentrically positioned in a cylindrical mold cavity. A foam mixture is poured into the cylindrical mold and cured to form a solid core. The core is removed from the mold and covered with a layer of fiberglass reinforced plastic, which is in turn covered by an elastomeric layer. The cylindrical mold may be eliminated by using a fiberglass sleeve as a mold. After curing the foam mix, the fiberglass sleeve is covered with an elastomeric layer.

Similarly, U.S. Pat. No. 442,603 shows a platen manufactured by concentrically casting a hollow hard rubber core around a shaft. The core is, in turn, covered by a softer rubber layer which is applied by vulcanization or by slipping on a separate sleeve.

Still another typical platen construction is disclosed in In U.S. Pat. No. 3,646,652. Specifically, a substantially rigid core is concentrically positioned within a plastic sleeve. The annular gap between the core and sleeve is then filled with a resilient filler.

Each of the constructions in the three last mentioned patents would, at least, require further fabrication after the molding operation if they were to be used in any equipment requiring high precision. Typically, they would require final grinding of the sleeve and/or precise machining thereof to obtain the necessary accuracy of construction. It is important in high speed printers that the platen has a smooth and non-eccentric cylindrical outer surface and that this surface be maintained during high speed rotation. With platens constructed in accordance with the teachings of the above patents, surface distortion or eccentricity would likely result. Correction by machining of the parts or surface grinding of the sleeve is expensive. To reduce manufacturing costs, it is desirable to eliminate these fabricating steps.

SUMMARY OF THE INVENTION

A platen constructed in accordance with the teachings of the invention has precise concentric alignment between the outer circumferential surface of the platen and the shaft means without expensive machining or use of rigid tubes and separately assembled sleeves of the above known platen designs. Further, the disclosed method of manufacture inexpensively produces a platen having precise concentric alignment between the shaft means and the outer circumference of the platen sleeve without the need for expensive sleeve grinding after manufacture.

In construction, the platen of the present invention has a resilient tubular sleeve with a smooth outer cylindrical surface. Shaft means is contained within the sleeve with exposed portions at the sleeve ends which are aligned axially with respect to each other and concentrically with respect to the outer cylindrical surface of the sleeve. A molded in place core, disposed between the shaft means and the sleeve, connects them together and prevents their relative rotation. In one embodiment, the shaft means is a one-piece shaft. In other embodiments, the shaft means is a pair of independent shaft portions extending part way into the sleeve ends. In still other embodiments, a center support member is disposed within the sleeve and loosely engaged on the shaft portions.

The method of manufacturing the platen of the present invention comprises using the sleeve as a mold member. The sleeve is one which is pre-constructed with a precision outer cylindrical surface, as for example, by centerless grinding. One end of the sleeve is first capped with a shaft portion concentrically aligned within the capped end. Moldable plastic material, such as polyurethane foam, is fed into the interior of the sleeve to paritally fill it. The other end of the sleeve is then capped, with the second portion of the shaft means being aligned with the first shaft portion and with the sleeve. Next, the plastic material is cured to form a molded in place core between the shaft means and sleeve which bonds them in a concentric relationship and prevents their relative rotation. If desired, the outer surface of the sleeve may be constrained to prevent expansion during molding and curing.

BRIEF DESCRIPTION OF THE DRAWINGS

FIG. 8 is a cut-away plan view of another embodiment of the platen similar to that of FIG. 5, but where the center support member is of open construction;

FIG. 9 is a cross-sectional view taken along lines 9—9 of FIG. 8;

FIG. 10 is a cross-sectional view showing a different embodiment of the open support member of the platen;

FIG. 11 is a cross-sectional view showing still another embodiment of the open support member of the platen.

DESCRIPTION OF THE PREFERRED EMBODIMENTS

Figure 1:
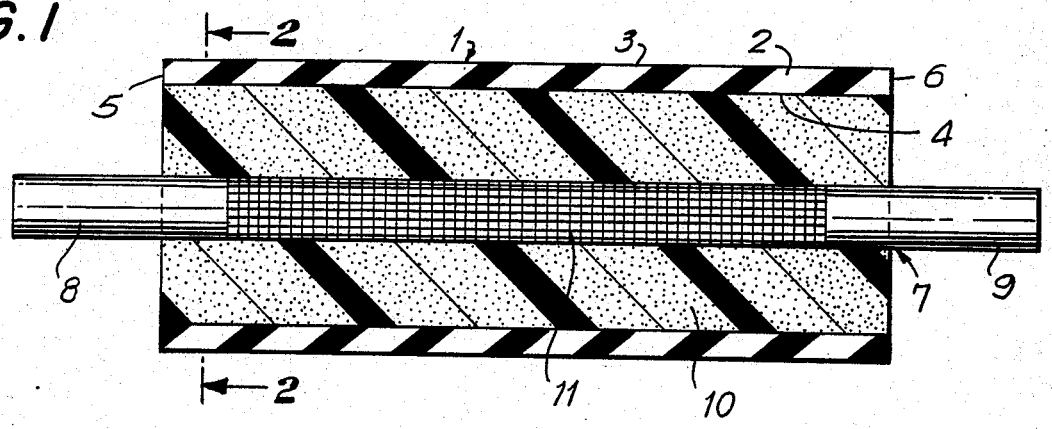
FIG. 1 is a cross-sectional plan view of one embodiment of the platen constructed in accordance with the teachings of the present invention.
Figure 2:
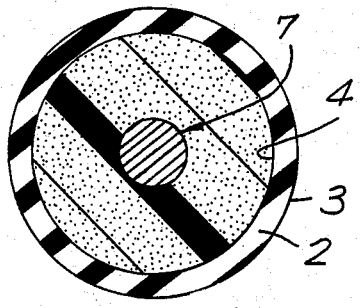
FIG. 2 is a cross-sectional view taken along lines 2—2 of FIG. 1.

FIGS. 1 and 2 show a platen 1 having a resilient tubular sleeve 2 constructed of a material such as rubber. Sleeve 2 has a cylindrical outer circumferential surface 3, an inner circumferential surface 4 and sleeve ends 5 and 6. Shaft means 7 is contained within the sleeve. In the embodiment of FIG. 1, the shaft means is a single piece shaft having end portions 8 and 9 which are exposed at the sleeve ends 5 and 6. A molded in place core 10 is disposed between the sleeve's inner circumferential surface 4 and the shaft means 7.

As shown in FIG. 2, the molded core 10 fixes the aligned position of the end portions 8 and 9 of the shaft concentrically with respect to the outer surface 3 Of sleeve 2. It also prevents their relative movement. Polyurethane foam is the preferred core material. It adheres well to the inner circumferential surface 4 of sleeve 2 and to shaft means 7. To improve adhesion of the core 10 to the shaft 7, the surface 11 of the shaft is roughened. Similarly, the sleeve's inner circumference 4 may be roughened to improve adhesion to the sleeve.

In FIG. 1, the exposed portions 8 and 9 of shaft 7 will ride in bearings (not shown) which mount the platen within the printer. It is desirable to make the shaft portions 8 and 9 relatively hard to reduce wear as they ride in the printer bearings. Slender, long shafts such as shaft 7 tend to axially stress warp when subjected to the normal hardening process. For example, with a length of the order of 20 inches, any axial warpage from shaft hardening would make it difficult to precisely align end portions 8 and 9 concentrically with the sleeve outer surface 3. Elimination of shaft 7 hardening eliminates the potential for stress warpage. While the shaft 7 may be precisely hardened and straightened to prevent axial warpage during the hardening process, such techniques are very expensive. Plating the shaft 7 with a hard finish, such as hard chrome, tin-nickel, or electroless nickel improves the surface hardness of the shaft without the need of undergoing expensive shaft hardening processes. These plated finishes also reduce surface wear to acceptable limits.

In alternate embodiments of the invention shown in the drawings, multiple-piece hardened shaft means are used. The multiple shafts are of short lengths and not adversely affected by normal hardening processes. These multiple shafts can therefore provide precise concentric alignment between the exposed portions of the shafts and the outer surface of the sleeve.

Figure 3:
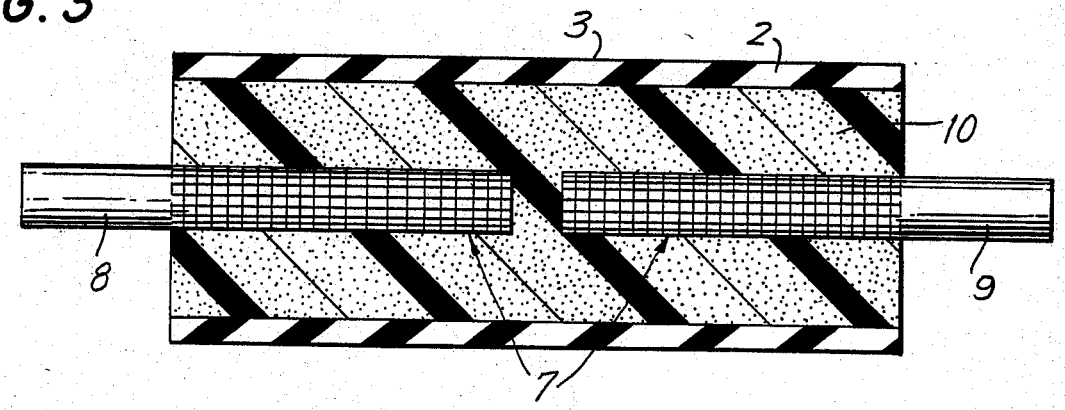
FIG. 3 is a cross-sectional view of another embodiment of the platen wherein double shafts are used.

FIG. 3 shows a platen with a multiple-shaft means 7. It includes a pair of shafts extending into the core and almost touching each other. Each of the exposed portions 8 and 9 of the shafts are aligned with the outer surface 3 of the sleeve.

Figure 4:
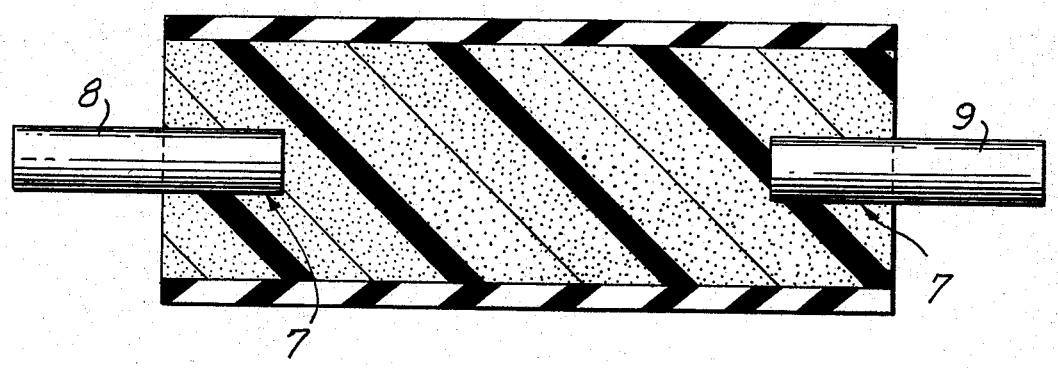
FIG. 4 is a cross-sectional view of still another embodiment of the platen similar to that of FIG. 3.

In FIG. 4, the multiple-shaft means 7 is a pair of shafts which extend axially inwardly a lesser distance into the core than the shafts shown in FIG. 3. The embodiments of FIGS. 3 and 4 offer less platen rigidity to resist deflections from printer element impact than the platen with the one piece shaft shown in FIG. 1.

In other multiple-shaft embodiments shown in FIGS. 5–12 sufficient platen rigidity is provided for resisting deflections from printer element impacts. The rigidity is accomplished by use of a center support member 12 located between the shaft portions 8 and 9. The center support loosely engages the adjacent ends of the two shaft portions 8 and 9.

Figure 5:
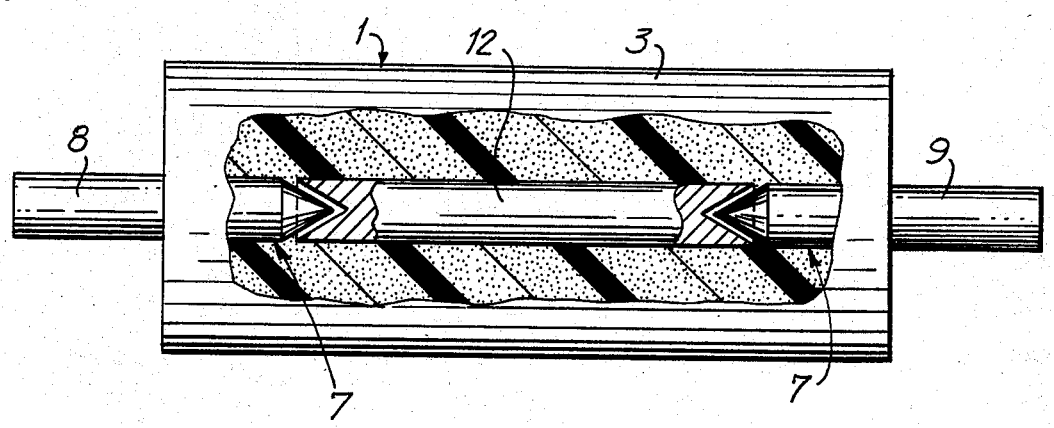
FIG. 5 is a cut-away plan view, partly in cross-section, of another embodiment of my platen wherein a center support is used to enhance rigidity of the platen.

In FIG. 5, the shaft portions 8 and 9 have conically tapered male internal ends which loosely engage conically tapered bores in the support member 12. The center support is a shaft construction.

Loose engagement between the shaft portions and center support locates the support roughly in the center of the platen and keeps it from falling out during the molding process. By providing a loose engagement, the addition of the center support does not interfere with the precision aligning which is required of the shaft portions with each other and with respect to the outer surface of the sleeve. During the molding of the core, the plastic material flows between the loosely engaged shafts and center support and further adds rigidity to the platen structure by connecting them together.

Figure 6:
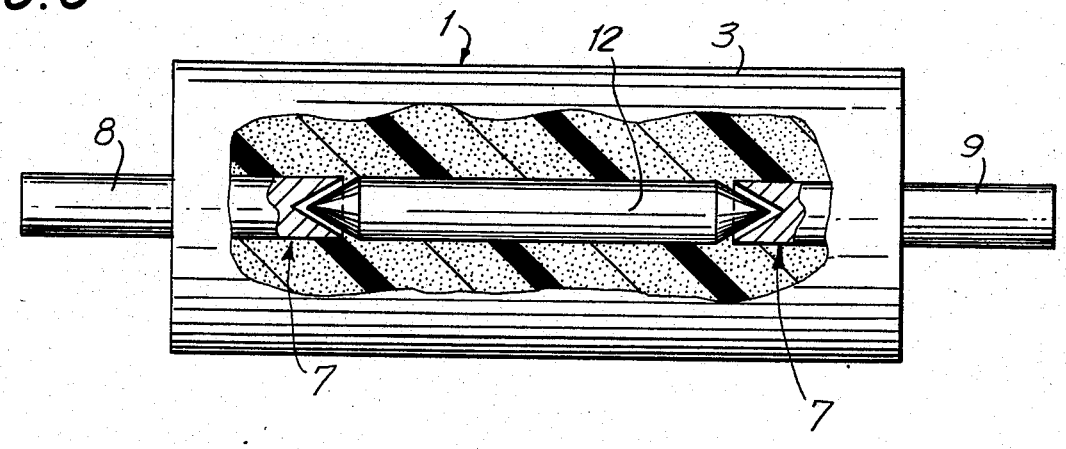
FIG. 6 is a cut-away plan view of an embodiment of a platen similar to that of FIG. 5.

The embodiment shown in FIG. 6 is similar to that shown in FIG. 5 except that the connection between the shaft portions and center support is reversed. More particularly, the male conically tapered ends are on the center support and the female conically tapered bores are on the shaft portions.

Figure 7:
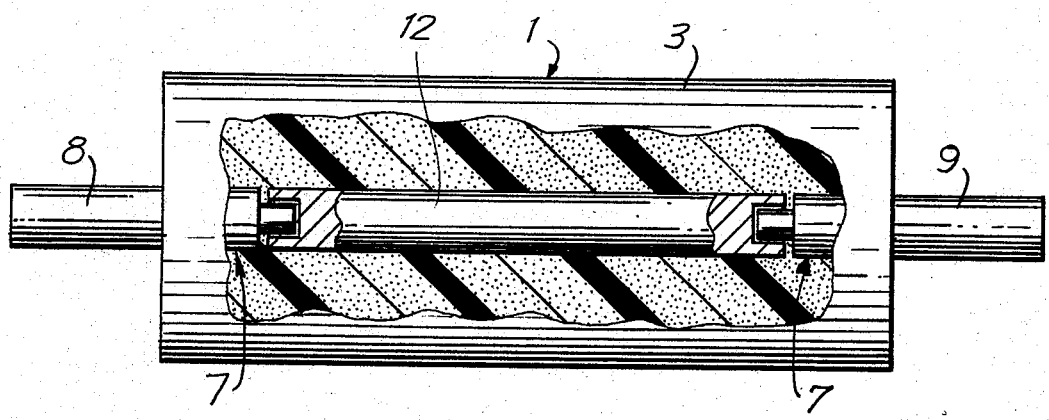
FIG. 7 is a cut-away plan view of still another embodiment of the platen similar to that of FIG. 5.

In the embodiment shown in FIG. 7 the loose engagement of the shaft portions with the center support is effected by having the shaft ends of reduced diameter. The center support, on the other hand, has straight female bores on either end of a size to loosely fit with the ends of the shaft means.

In the embodiment shown in FIGS. 8–11 the center support is of channel construction. FIGS. 8 through 11 show different cross-sectional profiles for the channel. In FIGS. 8 and 9, the channel is three sided and triangularly shaped, with an open apex 13. In FIG. 10, the channel is also triangularly shaped, but has a wider gap at the open apex. The channel in FIG. 11 has two sides. In each embodiment the channel structure is loosely supported on the adjacent ends of the shaft portions 8 and 9. The molded core 10 fills the gap between the shaft portions and channel structure.

Figure 12:
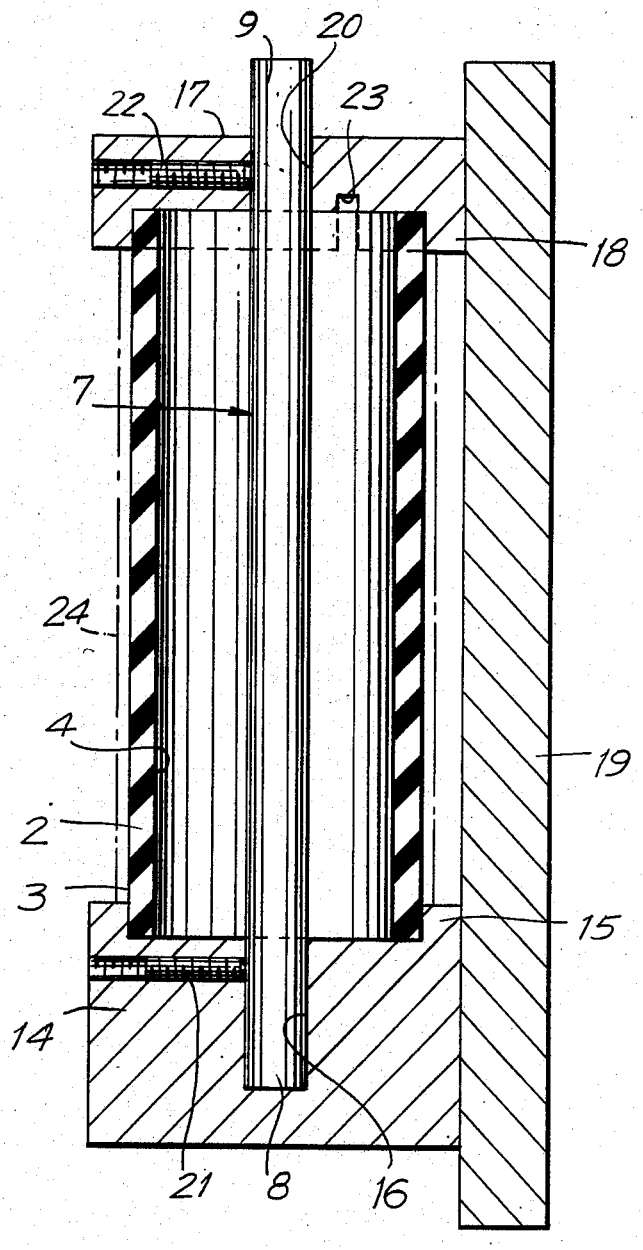
FIG. 12 is an elevational view of a molding apparatus used to make the platen in accordance with the teachings of the present invention.

The method of manufacturing the platen constructed in accordance with the teachings of the invention provides precise axial alignment between the shaft portions and concentric alignment of the shaft portions and the outer circumferential surface of the platen. FIG. 12 shows an apparatus suitable for use in the manufacturing of the platen.

As shown in FIG. 12, sleeve 2 is supported at one end on a mold block 14. Mold block 14 has an annular skirt 15 which has an inner diameter matching the outer diameter of the sleeve. The block is constructed with a bore 16 extending axially of the sleeve 2 when supported on the block. In the embodiment shown in FIG. 12, the bore 16 receives the end portion 8 of a single shaft 7 extending the full length of the sleeve.

With the sleeve 2 and shaft 7 in place in the mold block, moldable plastic material is poured into the sleeve's interior. In the preferred embodiment, the moldable material is a polyurethane foam mixture. Partially filling sleeve 2 with polyurethane foam will lead to complete filling of the sleeve after the foaming action of the polyurethane material. Upon filling the sleeve 2 with polyurethane foam, the other end of the sleeve is capped with mold block 17. Mold block 17 has an annular skirt 18 with inner diameter matching the outer diameter of the sleeve 2. Mold blocks 14 and 17 attach to frame 19 of the apparatus by means well known in the art such as bolts (not shown).

During final capping, the portion 9 of shaft 7 is inserted through the bore 20 provided in the mold block 17. This bore is axially aligned with bore 16 and both bores are concentrically aligned with respect to the inner surfaces of the respective skirts 15 and 18. Adjustable screws 21 and 22 are provided to fix the position of shaft 7 in the apparatus.

The polyurethane foam is cured to form the molded in place core of the platen. During curing, the polyurethane foam releases gasses and air which is present in the cavity. To prevent the gasses from accumulating, and forming gas pockets in the core, mold block 17 is provided with vent 23. Vent 23 permits release of gasses from the core to the atmosphere, resulting in complete filling of the cavity. After curing, mold block 17 is disassembled and the finished platen removed.

With the present method of constructing the platen with the core molded in place within the sleeve, the structure when removed from the molding apparatus will have the shaft portions axially aligned with respect to each other and concentrically aligned with the outer surface of the sleeve. In order to assure this latter relationship, the sleeve must, of course, have a precision outer surface. In accordance with the teachings of the present invention, this is accomplished by grinding the outer surface of the sleeve prior to molding of the core. This permits the use of centerless grinding of the sleeve's outer surface. Centerless grinding is an accurate yet inexpensive grinding procedure compared with the grinding requirements of the prior art platens where the finished platen is mounted on the extending shaft portions for grinding.

In order to assure that the preground surface of the sleeve is absolutely maintained during the molding operation, the molding apparatus can be provided with an external sleeve member 24. This is shown in dotted lines in FIG. 12. This member is placed around the sleeve prior to the molding operation and is of sufficient rigidity to prevent any radial expansion of the sleeve during the molding operation. Alternatively, if the external sleeve member 24 is not used and expansion of the sleeve occurs during molding, a final grinding of the platen supported on the shaft ends may be employed in order to grind this surface to one which is concentric with the shaft means.

The embodiment of the platen shown in FIG. 12 employs a single shaft means 7. Where the multiple shaft means of FIGS. 3 through 11 are desired, the same apparatus shown in FIG. 12 may be used. It is simply necessary to separately insert and align the shaft portions 8 and 9 within the mold parts. Also, with the method as described with reference to FIG. 12, the filling of the plastic is effected prior to capping the upper end of the sleeve. Alternatively, both ends of the sleeve may be capped with the shaft portions aligned prior to filling the sleeve with the polyurethane foam. The plastic material will then be fed into the sleeve through a suitable port (not shown) in the mold structure.

I claim:

1. A platen for printers comprising:

(a) a resilient tubular sleeve having an outer cylindrical surface and;

(b) shaft means having exposed portions at the axial ends of the sleeve, said exposed shaft portions being concentrically aligned with the outer cylindrical surface of the sleeve, said shaft means comprising:

(1) first and second shafts extending partway into the core at each end of said tubular sleeve, and (2) a center support member disposed within said core between the first and second shafts and having support ends engaging the first and second shafts; and (c) a molded in place core disposed between and filling the space between the shaft means and the sleeve and connecting the shaft means and sleeve together in concentric relationship and against relative movement, said mold being constructed of moldable plastic material; and, (d) the engagement between the first and second shafts and the center supporting member being a loosely spaced connection with the spacing there between filled by the molded in place core material.

2. The platen according to claim 1 wherein:

(a) the connection between the first and second shafts and the center support member is a male-female connection.

3. the platen according to claim 2 wherein:

(a) the center support member is a channel member.

4. The platen according to claim 3 wherein:

(a) channel member has at least two sides extending axially of the platen.

5. The platen according to claim 4 wherein:

(a) The channel member is triangular in cross section with one apex of the triangle being opened and the interior thereof filled with the plastic material of said core.

* * * * *